US005639349A

United States Patent [19]

Begemann et al.

[11] Patent Number: 5,639,349

[45] Date of Patent: Jun. 17, 1997

[54] METHOD AND DEVICE FOR QUALITY IMPROVEMENT IN MULTILAYER AND MULTIPLY PAPERS

[75] Inventors: Ulrich Begemann, Heideheim; Hans-Peter Sollinger, Heidenheim; Udo Grossmann, Heidenheim; Dieter Egelhof, Heidenheim, all of Germany

[73] Assignee: Voith Sulzer Papiermaschinen GmbH, Heidenheim, Germany

[21] Appl. No.: 377,026

[22] Filed: Jan. 20, 1995

[30] Foreign Application Priority Data

Jan. 22, 1994 [DE] Germany ..... 44 01 761.8

[51] Int. Cl.[6] ..... D21F 1/66

[52] U.S. Cl. ..... 162/190; 162/203

[58] Field of Search ..... 162/190, 264, 162/203, 217, 303

[56] References Cited

U.S. PATENT DOCUMENTS 4,477,313 10/1984 Andersson ..... 162/190
4,895,623 1/1990 Corbellini ..... 162/364
5,196,090 3/1993 Corbellini et al. ..... 162/190

FOREIGN PATENT DOCUMENTS 3112966 10/1982 Germany .
4321268 12/1993 Germany .
4239647 6/1994 Germany .

*Primary Examiner*—Brenda A. Lamb
*Attorney, Agent, or Firm*—Baker & Daniels

[57] ABSTRACT

A method for improving the quality of multilayer and multiply papers in the wet section of a paper machine, wherein at least two stock suspensions of different quality are used for producing a paper web. The wire water removed through the paper machine wire is collected in separate vessels and recycled. At least the major part of a first stock suspension is dewatered through a first wire, while at least the major part of a second stock suspension is dewatered through a second wire. The wire water removed through each of the wires is collected, separately from the other wire water, and recycled to the stock suspension of the same layer.

5 Claims, 4 Drawing Sheets

METHOD AND DEVICE FOR QUALITY IMPROVEMENT IN MULTILAYER AND MULTIPLY PAPERS

BACKGROUND OF THE INVENTION

The invention concerns a method and device for quality improvement in multilayer and multiply papers made on a paper machine using multilayer headboxes or several separate headboxes for forming multiply papers.

The production of multilayer or multiply papers with the aid of multilayer headboxes or several successively arranged single-layer headboxes is known, e.g., in DE 43 21 268 A1.

These previously known paper production methods normally serve the manufacture of papers which feature an inner, low-grade paper layer, or paper ply. This inner paper layer is outwardly bounded by a high-grade paper layer or paper ply, which essentially determines the paper quality. In these methods, different grades of substance are used in the individual plies; i.e., the stock suspension of the inner layer, or ply, consists for instance of recycled paper, whereas the outer layers are made using a stock suspension of highest quality.

It has been demonstrated that the prolonged operation of a system involves a creeping deterioration of the quality of the outer layers.

DE 31 12 966 shows and describes a paper machine on which a two-ply web is created. The wire water of the upper ply passes through the lower ply and is removed by the lower wire. A clean separation of the different wire waters is thus not possible.

The problem underlying the invention is to propose a method and device which prevent the deterioration of the high-grade layers and thus result in an improved paper quality.

SUMMARY OF THE INVENTION

This problem is solved by the features of the present invention. A suitable separation of the wire water circulations ensures that a deterioration of the stock suspension for the high-grade layers will be avoided.

The inventors recognized that an appreciable difficulty in the manufacture of multiply or multilayer papers is that in the course of the operation of a plant there occurs a mixing of the wire water coming, for one, from the low-grade layers, for instance of recycled paper, and of the wire water contributed by the high-grade layers. Therefore, the invention ensures that such mixing process will be greatly reduced, or avoided, in the manufacture of the paper, by providing separate wire water circulations for the high-grade and the low-grade wire water.

In the case of multiply papers, i.e. papers which are created with the aid of several straight headboxes, the invention ensures that the wire water accruing in the dewatering section which can be clearly coordinated with a specific headbox will be passed again to this very headbox by way of the stock suspension treatment. That is, the dewatering units following a headbox are assigned, per each headbox, a line system which recycles the relevant stock suspension again to the pertaining treatment section.

With a multilayer headbox, i.e. a headbox dispensing as one unit two or three layers of different quality, a separation of wire water circulations is possible as well.

With for example two layers of different stock suspension quality passed between a twin wire, it can be presumed that relatively clear wire water of the relevant stock suspension issues out of the wires at least in the initial area of dewatering. That is, in the initial area of dewatering the presumption is that only wire water of the stock suspension layer contained on the top wire side will pass through the top wire, while the wire water penetrating the bottom wire carries only wire water of the respective stock suspension. Here, the option then is given to recycle to the high-grade layer only the wire water which initially issues out of the relevant side, whereas the remainder of the wire water is returned again to the low-grade layer.

Considering for instance a triple-layer sheet formation where the inner layer consists of recycled paper and the two outer layers of high-grade paper, it may be presumed that in an initial dewatering area only, or primarily, wire water of the better grade issues out of the two sandwiched wires, whereas, beginning at a specific advance of the dewatering, essentially only the wire water of the recycled paper layer discharges. Here too, an appropriately separated wire water management is feasible, whereby the wire water circulations of the higher-grade layers can be kept clean.

In addition to sectioning the wire water circulation as illustrated above, it is possible to effect a sectioning such as illustrated in the patent document DE 42 39 647 A1, that is, performing in addition to separating the wire water circulation in machine direction also a separation of the wire water circulation in cross direction, thereby creating a smoothing of the paper web such as described in the aforementioned patent document.

BRIEF DESCRIPTION OF THE DRAWINGS

Exemplary embodiments are illustrated in the figures, wherein.

DETAILED DESCRIPTION OF THE INVENTION

The figures show merely schematic illustrations of the sheet formation and dewatering units. It is presumed that the expert in the field will choose the detail design in keeping with the prior art.

Figure 1:
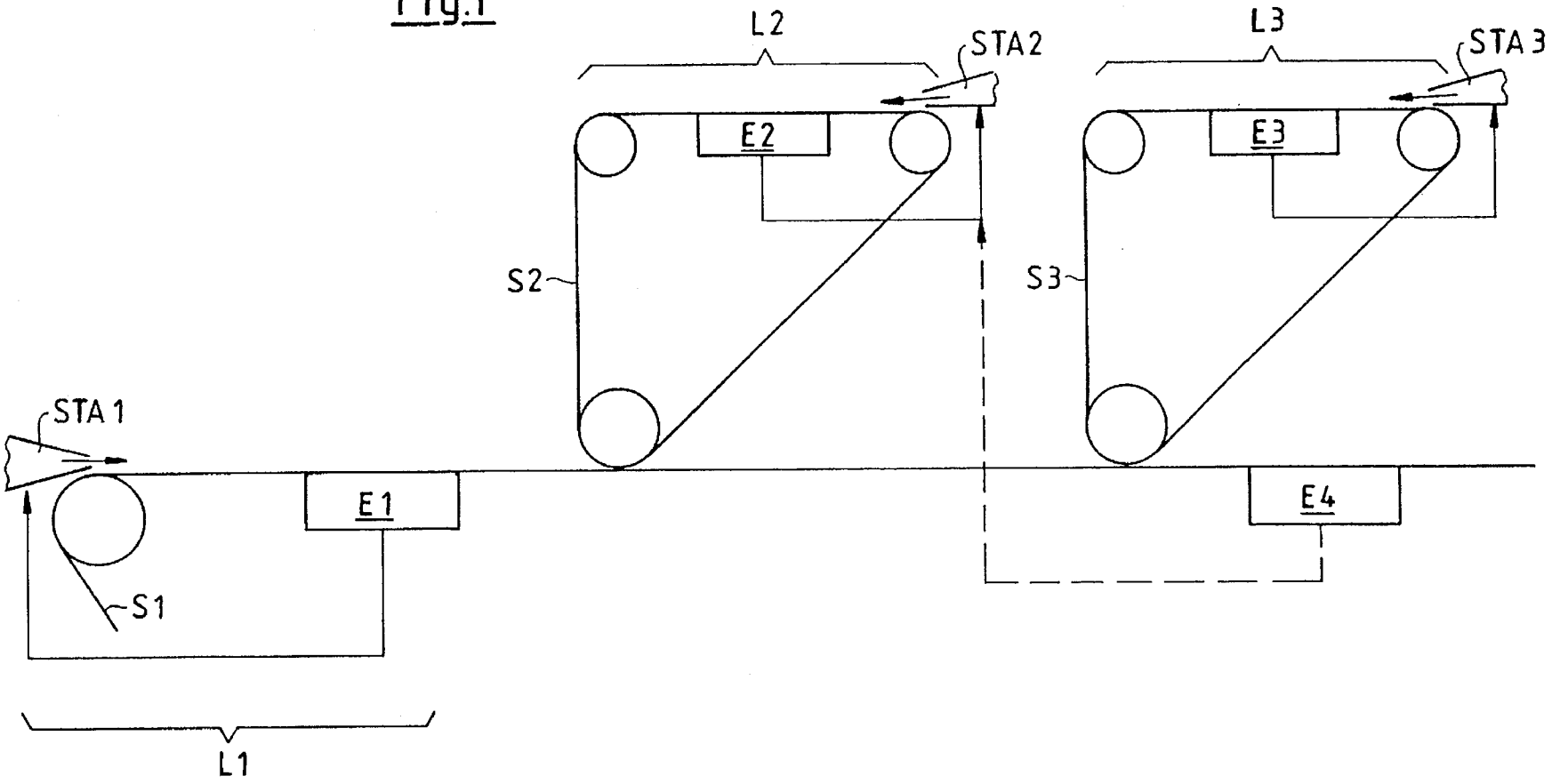
FIG. 1 shows a separate wire water management in a triple-ply sheet formation.

FIG. 1 shows a schematic illustration of a multiply sheet formation, depicting three sheet formation zones of plies L1–L3, each zone including a wire S1–S3 with a pertaining headbox STA1–STA3 and a dewatering zone E1–E3. Receiving the first ply, wire S1 runs past the wires S2 and S3, with the paper plies being picked up by these wires. Dewatering by the dewatering units E1–E3 is mutually separated, so that self-contained wire water circulations are obtained. Merely a subsequent dewatering E4, which withdraws the residual water from the entirety of paper plies, finally passes its wire water to the headbox STA2, i.e., to the headbox of the middle ply, the presumption in the illustrated case being that the middle ply is the low-grade paper ply, so that, if anything, an improvement of the wire water quality will take place thereby.

Figure 2:
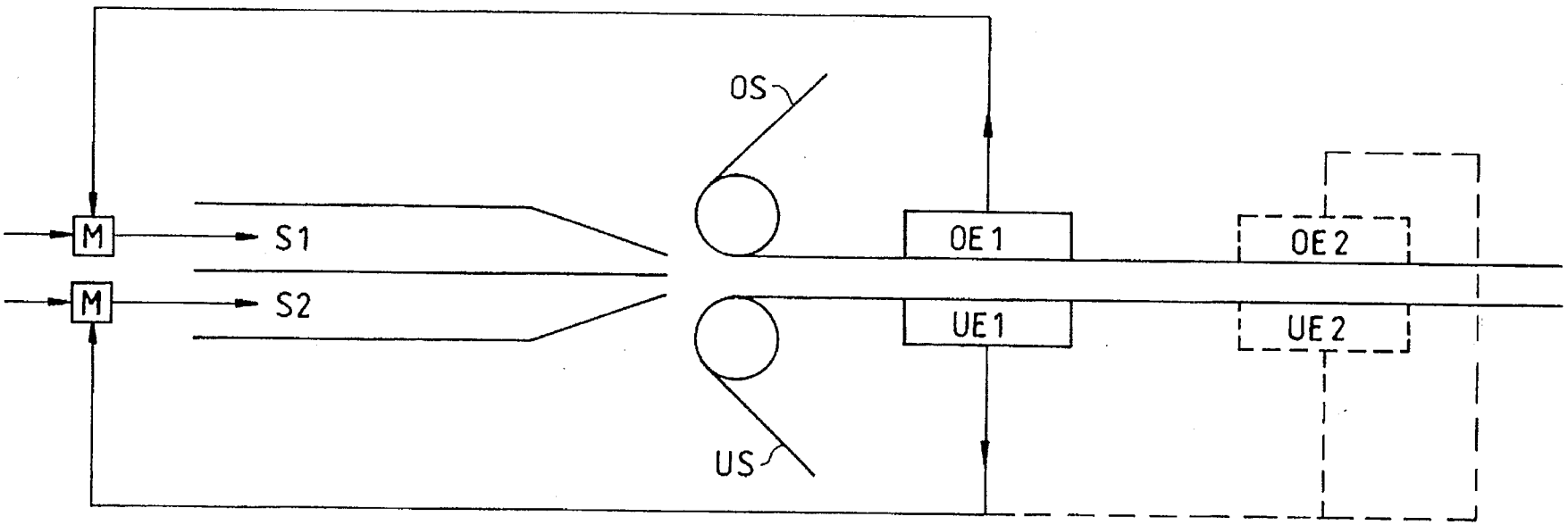
FIG. 2 shows wire water management in two-layer sheet formation.

FIG. 2 shows a sheet formation with the aid of a two-layer headbox introducing the stock suspensions S1 and S2 between a top wire OS and bottom wire US. Provided on the top wire side is a first top wire dewatering OE1 and on the bottom wire side a first bottom wire dewatering UE1, with both dewaterings extending to a separate wire water circulation, so that the water issuing out of the top wire is being returned to the upper layer while the wire water issuing from the bottom wire is being passed to the lower layer. Also illustrated (by dashed line) is a further dewatering zone with two dewatering units OE2 and UE2, the presumption being that in this area a mixing of the suspensions has already been possible, so that a clear separation between the wire water of suspension 1 and suspension 2 is no longer possible. Therefore, the management of wire water from the two units OE2 and UE2 is optionally combined and the water introduced in the lower-grade suspension S2, illustrated in this case by way of example.

Figure 3:
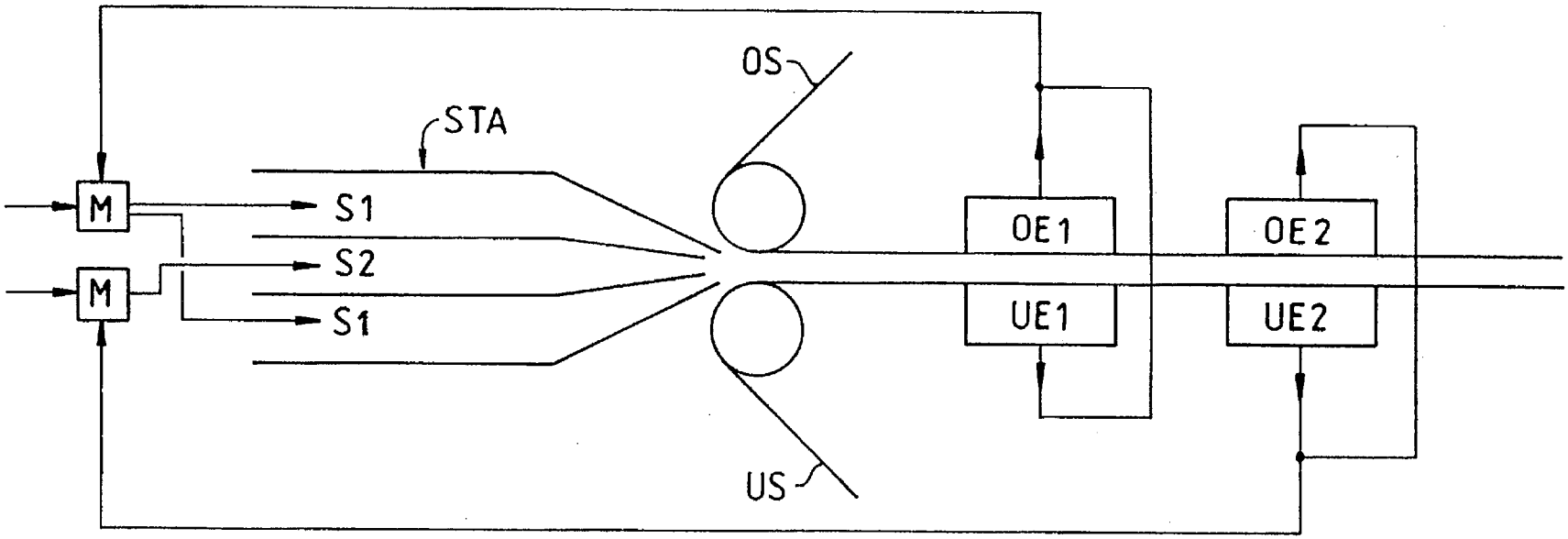
FIG. 3 shows wire water management in triple-layer sheet formation.

FIG. 3 shows as well a schematic illustration of the wire water circulation of a sheet formation unit with a triple-layer headbox, the presumption here being that the two outer layers S1 are equivalent and enclose an inner, lower-grade layer S2. Illustrated is a triple-layer headbox STA which introduces the layered stock suspensions between an upper wire OS and a lower wire US, with a first dewatering of the upper wire and lower wire, OE1 and UE1, schematically illustrated as following the headbox. Consisting essentially of the wire water of stock suspension S1, the first dewatering is taken from an upstream area of the wet section of the paper machine, and is collected and separately recycled, through a mixer, to the two outer layers via the stock suspension S1 and the headbox STA. In the further course of dewatering, dominated by the stock suspension S2, a separate wire water circulation is provided for the second dewatering units OE2 and UE2 used there in an area of the wet section located downstream of the first dewatering area, which circulation introduces the collected stock suspension in the circulation of stock suspension 2.

Figure 4:
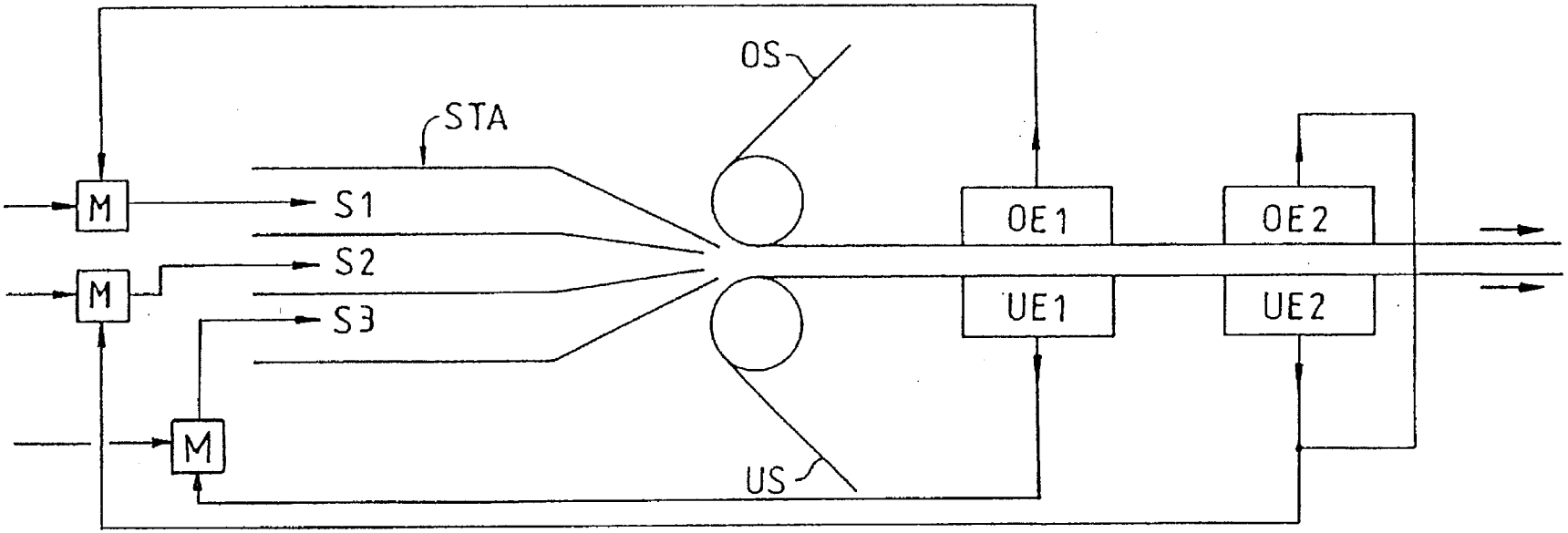
FIG. 4 shows wire water management in a further triple-layer sheet formation.

FIG. 4 is a schematic illustration of the wire water circulation with a sheet formation unit, again with a triple-layer headbox. As opposed to the embodiment relative to FIG. 3, however, different grades of stock are used for the outer layers S1 and S3.

What is claimed is:

1. In a method for improving the quality of multilayer and multiply papers in the wet section of a paper machine, wherein at least two stock suspensions of different quality are used in the paper machine for producing a paper web, and wherein each stock suspension is dewatered by removing wire water from said suspension, the improvement comprising:

at least the major part of a first stock suspension is dewatered by removing said wire water through a first paper machine wire, and at least the major part of a second stock suspension is dewatered by removing said wire water through a second paper machine wire; and the wire water removed through one of said paper machine wires is collected separately from the wire water removed from the other paper machine wire and the collected wire water is recycled to the stock suspension from which the wire water was removed.

2. The method of claim 1, wherein the at least two stock suspensions are separately fed as a multilayer suspension jet to a twin wire zone of the paper machine, in which said two paper machine wires comprise continuous wires and form together said twin-wire zone, wherein said twin-wire zone has an initial area, and wherein the separate collection of the different wire waters substantially takes place in said initial area of the twin-wire zone.

3. The method of claim 1, wherein three stock suspensions are used for producing a triple-layer paper sheet, said triple-layer sheet comprising two outer layers and an inner layer formed from respective stock suspensions, and wherein wire water is initially removed through said wires in a first area of said wet section, said initially removed wire water substantially originating from said outer layers, said initially removed wire water being recycled to stock suspension for the outer layers; and wherein wire water is subsequently removed through said wires in a second area of said wet section which is downstream relative to the path of travel of the paper web to said first area, said subsequently removed wire water being recycled to stock suspension for the inner layer.

4. The method of claim 1, wherein the multilayer and multiply papers comprise outer layers enclosing a middle layer, said outer layers comprising substantially similar compositions of stock suspension, wherein wire water stemming essentially from the outer layers is removed in a first, upstream area of said wet section, and recycled to the stock suspension for said outer layers; and wire water is removed in a second, downstream area of said wet section relative to the path of travel of the paper web to said first, upstream area and recycled to stock suspension for the middle layer.

5. The method of claim 1, wherein said paper machine has a machine width, said width being divided into a plurality of sections, and wherein the collected wire water is removed with respect to said plurality of sections to thereby obtain sectional streams of wire water; and wherein each of said sectional streams of wire water is recycled to said section from which it was removed.

* * * * *